United States Patent [19]

Takagi

[11] 3,948,038

[45] Apr. 6, 1976

[54] COUPLING STRUCTURE OF WATCHCASE

[75] Inventor: Katsuji Takagi, Tokyo, Japan

[73] Assignee: Heiwado Boeki Kabushiki Kaisha, Tokyo, Japan

[22] Filed: Mar. 10, 1975

[21] Appl. No.: 557,013

[30] Foreign Application Priority Data

| | | |
|---|---|---|
| Apr. 20, 1974 | Japan | 49-45106[U] |
| Apr. 23, 1974 | Japan | 49-46832[U] |
| Apr. 23, 1974 | Japan | 49-46833[U] |
| June 20, 1974 | Japan | 49-72817[U] |
| June 20, 1974 | Japan | 49-72818[U] |
| June 20, 1974 | Japan | 49-72820[U] |

[52] U.S. Cl. ..... 58/90 R

[51] Int. Cl.[2] ..... G04B 37/08

[58] Field of Search ..... 58/88 R, 88 W, 90 R

[56] References Cited

FOREIGN PATENTS OR APPLICATIONS

| | | | |
|---|---|---|---|
| 243,143 | 6/1946 | Switzerland | 58/90 R |
| 1,177 | 7/1915 | United Kingdom | 58/88 R |
| 220,794 | 4/1942 | Switzerland | 58/90 R |
| 229,555 | 10/1943 | Switzerland | 58/90 R |

*Primary Examiner*—George H. Miller, Jr.
*Attorney, Agent, or Firm*—McNenny, Farrington, Pearne & Gordon

[57] ABSTRACT

A watchcase coupling structure including an outer rim and coupling pins adapted to couple a front cap and a rear cap, wherein the coupling pins may be mounted in the outer rim and the rear cap without relying upon a threading-in method. Each of these coupling pins may take various configurations. Specifically, it may be the one which has an eccentricity by an amount corresponding to a margin required to adjust the force with which the packing interposed between the front cap and the rear cap is clamped or the one which is provided on its head with a slant portion to facilitate the operation of mounting. Furthermore, it may be the one which is provided on the front end with a notch or the like or the one which has a flange to prevent the pin from falling off. To employ the pin having the flange, the outer rim is provided with a keyhole-shaped notch and the circular head of the pin is symmetrically cut away to present a pair of parallel surfaces so that the pin head may be soothly guided along said keyhole-shaped notch.

6 Claims, 35 Drawing Figures

COUPLING STRUCTURE OF WATCHCASE

SUMMARY OF INVENTION

In one embodiment of the present invention, coupling of the rear cap and the outer rim is achieved by eccentric pins adapted to be mounted in said outer rim and said rear cap. Amount of eccentricity of this eccentric pin corresponds to a margin required to adjust the force with which the packing interposed between the front cap and the rear cap is clamped. In a further improved embodiment of the present invention, the operation of mounting the pin through the outer rim into the rear cap is facilitated by shaping the pin so that the periphery of the pin head and the shank present a consecutive slant surface. In another embodiment of the present invention, the pin is provided with a member adapted to be interposed between the outer rim and the rear cap and thereby to prevent the pin from falling off once said pin has been mounted in the outer rim and the rear cap. In still another embodiment, said member mounted on the pin to be interposed between the outer rim and the rear cap is replaced by a rigid flange formed in unison with the pin, in addition to the arrangement as mentioned above, and the outer rim of watchcase is provided with a keyhole-shaped notch in conformity with this arrangement of the pin while the circular head of the pin is symmetrically cut away to present a pair of parallel surfaces so that said head of the pin may be smoothly guided along said keyhole-shaped notch fron one end thereof. In still further another embodiment of the present invention, the forward end of the pin having the circular flange to be used in combination with the outer rim having the keyhole-shaped notch is extended in the form of a notch and, on the other hand, the pin insertion hole of the rear cap is formed as an opening extending therethrough to improve the efficiency of the assembling operation.

BACKGROUND OF INVENTION

The present invention relates to an improvement in a waterproof coupling structure of watchcase and, particularly, to an improvement in pins adapted to couple an outer rim which, in turn, couples a front cap to a rear cap to said rear cap to provide the desired waterproof effect and further to an improvement in the outer rim adapted for employment of said pin.

The pin of this type conventionally used to couple and hold the front cap and the rear cap of watchcase has had a thread thereon and been threaded through the outer rim into the rear cap having the correspondingly threaded hole. With such a watchcase coupling structure, the operation of assembling has been troublesome due to the particular step of threading-in operation and no external adjustment of the force with which the packing for waterproof effect is clamped has been possible.

To overcome these disadvantages, the present invention provides an improved coupling structure. A principal object of the present invention, therefore, is to improve the watchcase coupling structure and thereby to improve the efficiency in the operation of assembling the watchcase. A second object of the present invention is to couple the outer rim engaged with the front cap to the rear cap in such a manner that the force with which the packing principally for waterproof effect interposed between the front cap and the rear cap of watchcase may be easily adjusted. A third object of the present invention is to improve of configuration of the pin itself so that the operation of assembling the watchcase may be further facilitated. A fourth object of the present invention is to improve a configuration of the pin itself of a combination of configurations of the pin and the outer rim so as to prevent the pin from falling off once the watchcase has been assembled. The other objects of the present invention will be obvious from reading the following description in reference with preferred embodiments of the present invention.

The objects as mentioned hereinabove are achieved in accordance with the present invention by coupling the outer rim and the rear cap to establish coupling of the front cap and the rear cap utilizing an eccentric pin extending through the outer rim into the rear cap. The pin is configurated so that the periphery of pin head and the pin shank present a consecutive slant surface in order to facilitate the operation of mounting the pin through the outer rim into the rear cap. To prevent the pin from falling off once the pin has been mounted in the outer rim and the rear cap, the pin is provided with a member adapted to be interposed between the outer rim and the rear cap. As another measure to prevent the pin from falling off, said member mounted on the pin to be interposed between the outer rim and the rear cap is replaced by a rigid flange forced in unison with the pin and the outer rim is provided with a keyhole-shaped notch in conformity with such a particular arrangement of the pin, and the circular head of the pin is symmetrically cut away to present a pair of parallel surfaces so that the pin may be smoothly guided along said keyhole-shaped notch fron one end thereof. With the rear cap having a thin side wall, the pin having the circular flange to be used in combination with the outer rim having the keyhole-shaped notch has its shank end extended in the form of a notch and the pin insertion hole of the rear cap is formed as an opening extending through said side wall so that said shank end may be expanded to prevent the pin from falling off.

BRIEF DESCRIPTION OF DRAWING

Specific construction of the present invention will be now described in reference with the accompanying drawing in which:

FIGS. 1A and 1B show an embodiment of the conventional coupling structure of watchcase, of which FIG. 1A is a side view and FIG. 1B is a sectional view taken along a line 1B—1B in FIG. 1A with a mechanism serving as a movement to be incorporated inside the watchcase and a middle portion thereof being omitted;

FIGS. 2A and 2B show in vertical section a watchcase coupling structure utilizing eccentric pins as an embodiment of the present invention, respectively, with the middle portion of the watchcase being omitted, of which FIG. 2A shows said eccentric pins as inserted and FIG. 2B shows said eccentric pins as turned so as to clamp a waterproof packing;

FIGS. 4A to 4C successively show the eccentric pin according to the present invention so improved as to facilitate insertion thereof and a series of operation carried out with this eccentric pin vertical section, respectively, with the inner mechanism to be incorporated inside the watchcase and the middle portion thereof being omitted, of which FIG. 4A shows the eccentric pin as immediately after inserted, FIG. 4B shows the eccentric pin as forced in by making good use of a slant portion thereof and FIG. 4C shows the eccentric pin as turned after forced in so as to clamp the waterproof packing;

FIGS. 5A and 5B show in vertical section another embodiment of the present invention with the inner mechanism inside the watchcase and the middle portion being omitted, respectively, this embodiment including the pins for coupling and profile members to be engaged into said pins so improved to prevent said pins from accidentally falling off, of which FIG. 5A shows a state at which only the pins extend through an outer rim into holes of a rear cap and FIG. 5B shows a state at which the profile members as will be shown more in detail by FIG. 6B are inserted into a gap between the outer rim and the rear cap and at the same time engaged into reduced diameter portions formed in middle portions of the pins;

FIGS. 9A and 9B show in vertical section a coupling structure of watchcase of such a type that the rear cap and the outer rim of the watchcase are coupled by using the eccentric pins as shown by FIG. 8, respectively, with the inner mechanism and the middle portion being omitted, of which FIG. 9A shows a state immediately after the eccentric pins as shown by FIG. 8 have been inserted through the rear cap and the outer rim and FIG. 9B shows a state at which the eccentric pins have been turned by 90° from the position of FIG. 9A.

FIGS. 10A to 10D show a coupling structure of watchcase as still another embodiment of the present invention employing pins having their heads configurated in the manner similar to the pin as shown by FIG. 8 but without eccentricity, namely, pin for coupling as shown in an enlarged scale by FIG. 11, of which FIG. 10A is a side view showing a state on the way the head of the pin whose shank portion has been inserted through the rear cap is introduced into a hole of the outer rim, FIG. 10B is a vertical section taken along a line XB—XB in FIG. 10A with the inner mechanism and the middle portion being omitted, FIG. 10C is a side view showing a state at which the coupling pin has been turned and thereby coupling operation of the coupling mechanism of watchcase has been completed and FIG. 10D is a vertical section taken along a line 10D—10D in FIG. 10C with the inner mechanism and the middle portion being omitted;

FIGS. 12A and 12B show a coupling pin of watchcase in still another embodiment of the present invention wherein the pin as shown by FIG. 11 is provided with a rigid flange formed in unison with said pin in order to prevent said pin from falling off, of which FIG. 12A is an enlarged perspective view and FIG. 12B is an enlarged plan view;

FIGS. 13A and 13B show a state on the way of assembling during which coupling of the watchcase is effected by utilizing the pins as shown by FIG. 12, of which FIG. 13A is a side view showing the head of the pin whose shank has been inserted through the rear cap is going to be introduced into an opening of the outer rim and FIG. 13B is a vertical section taken along a line 13B—13B in FIG. 13A with the inner mechanism and the middle portion being omitted;

FIGS. 13C and 13D show a state at which the operation of assembling has been completed, of which FIG. 13C is a side view and FIG. 13D is a vertical section taken along a line 13D—13D in FIG. 13C with the inner mechanism and the middle portion being omitted;

FIGS. 14A and 14B show a coupling pin of watchcase in further still another embodiment of the present invention wherein the pin shank as shown by FIG. 12 is provided in the forward end with a notch, of which FIG. 14A is an enlarged perspective view and FIG. 14B is an enlarged plan view;

FIGS. 15A and 15B show a state on the way of assembling during which coupling of the watchcase is effected by utilizing the pins as shown by FIG. 14, of which FIG. 15A is a side view showing the head of the pin mounted in the rear cap is going to be introduced into a hole of the outer rim and FIG. 15B is a section taken along a line XVB—XVB in FIG. 15A with the inner mechanism and the middle portion being omitted; and FIGS. 15C and 15D show a state at which the operation for coupling of the watchcase has been completed, of which FIG. 15C is a side view and FIG. 15D is a section taken along a line XVD—XVD in FIG. 15C with the inner mechanism and the middle portion being omitted.

DETAILED DESCRIPTION OF INVENTION

Figure 1A:
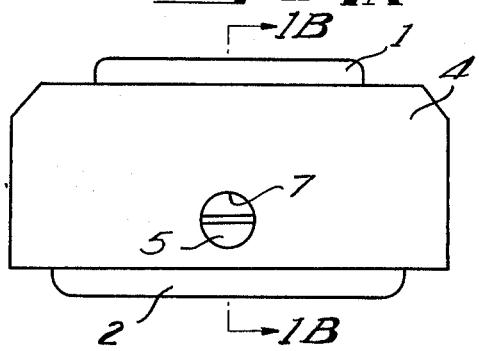
PRIOR ART Fig. 1A
Figure 1B:
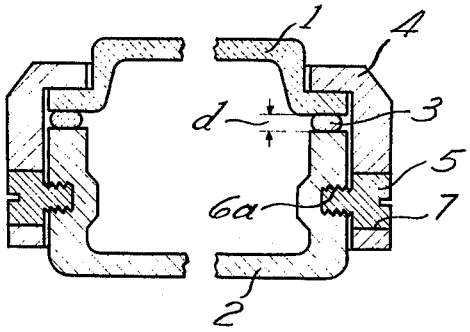
PRIOR ART Fig. 1B

Referring to FIG. 1 which shows by way of example the conventional coupling structure of watchcase, reference numeral 1 designates a front cap of a watchcase and 2 a rear cap thereof arranged behind the front cap 1 in opposition to said front cap 1. There is provided a packing 3 such as an O-ring between the front cap 1 and the rear cap 2 to assure a waterproof characteristic of a watch. An outer rim 4 extends along the sides of the front cap 1 and the rear cap 2, completely enclosing the portions of these both caps that are closely opposed to each other is provided at its upper portion with an engaging portion adapted to be engaged with the front cap 1 and screw pins 5 for coupling are threaded through openings 7 of the outer rim 4 into threaded holes 6a of the rear cap 2 so that the desired coupling of the coupling structure of watchcase comprising a combination of the elements as mentioned above may be effected. It should be noted here that FIG. 1 shows by way of example a basical arrangement of the watchcase coupling structure which is common to all the embodiments of the present invention as shown except the screw pins 5, the threaded holes 6 of the rear cap 2 and the openings 7 of the outer rim 4. In the coupling structure as shown by FIG. 1B, the screw pins 5 are adapted to be threaded into the rear cap 2, so that a separate operation of threading this screw pins 5 is required in the coupling structure of watchcase of such a type. Furthermore, this conventional structure includes no arrangement for selective adjustment of a force with which the packing 3 is clamped.

Figure 2A:
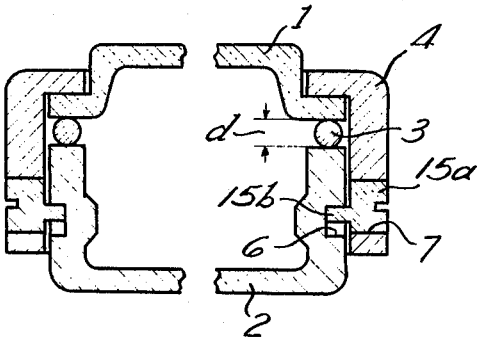
Figure 2B:
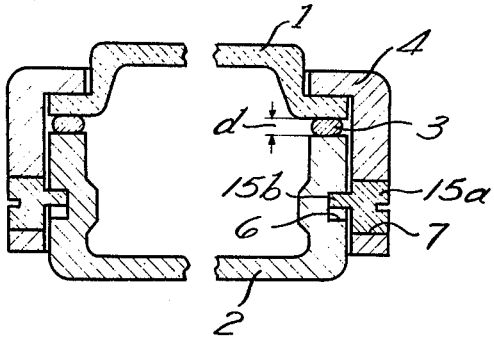
Figure 3:
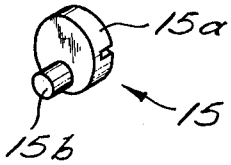
FIG. 3 is a perspective view showing in an enlarged scale the eccentric pins used in the embodiment as shown by FIGS. 2A and 2B.

The screw pin 5 is replaced, in the embodiments of the present invention as shown by FIG. 2 and the following, by a pin without a thread which may be variously modified as specifically shown. In the embodiment of FIGS. 2A and 2B, eccentric pins 15 as shown by FIG. 3 are used as the pins for coupling of the outer rim 4 and the rear cap 2, and a thickness of the packing 3 designated by reference symbol *d* in the figure may be varied through adjusting a distance between the front cap 1 and the rear cap 2 by rotary adjustment of the eccentric pins 15. An eccentric pin as shown by FIG. 4 consists of a head 5*a* and a shank 5*b*, and a distance between axes of these two portions has an eccentricity necessary as an allowance to adjust the force with which the packing 3 is clamped. As for determination of said eccentricity, its extent may be at least ½ of said allowance for adjustment of the force with which the packing 3 is clamped, since the eccentric pin 5 can be rotated by 180°. In practice, however, it is preferred that said eccentricity should be slightly larger than the minimum extent. In the state of FIG. 2B at which the operation of adjusting the force with which the packing 3 is clamped has been completed, the eccentric pin 15 should not be able to be further rotated unless dismantling of the watchcase coupling structure is required. As the simplest means to prevent, the eccentric pin 15 from further rotation, a frictional force developing between the head 15a of the eccentric pin 15 and the opening 7 of the outer rim 4 is utilized.

Figure 4A:
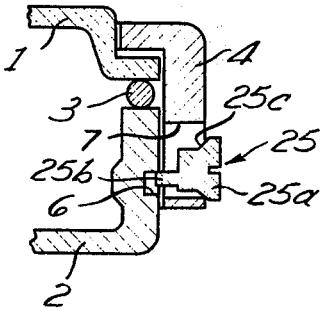
Figure 4B:
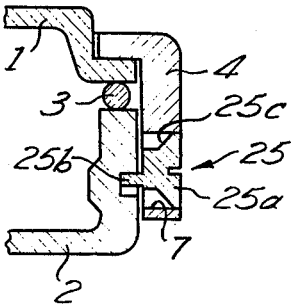
Figure 4C:
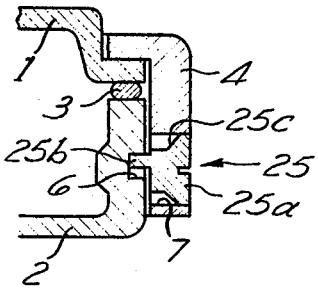

FIGS. 4A to 4C show an improved and modified eccentric pin 25 which is so formed that a head 25*a* and a shank 25*b* of this pin are connected by a slant surface 25*c*. As seen in FIG. 4A, the eccentric pin 25 is of an arrangement such that, after the forward end of the shank 25*b* has been inserted through the opening 7 of the outer rim 4 slightly into the hole 6 provided in the rear cap 2, the head 25*a* comes in contact with said opening 7 of said outer rim 4. In the course to the state of FIG. 4B at which the eccentric pin 25 has been forced from the state of FIG. 4A further inward, the head 25*a* of the eccentric pin 25 may be easily centered with the opening 7 of the outer rim 4 under a centering force developing as the slant surface 25*c* of the eccentric pin 25 comes in contact with a mouth of the opening 7 of the outer rim 4. The eccentric pin 25 now completely inserted through the opening 7 of the outer rim 4 into the hole 6 of the rear cap 2 takes the position as shown by FIG. 4B, and then said pin 25 is further adjustably turned to regulate the force with which the packing 3 is clamped as represented by the state of FIG. 4C at which the operation of coupling of the watchcase is completed.

Figure 5A:
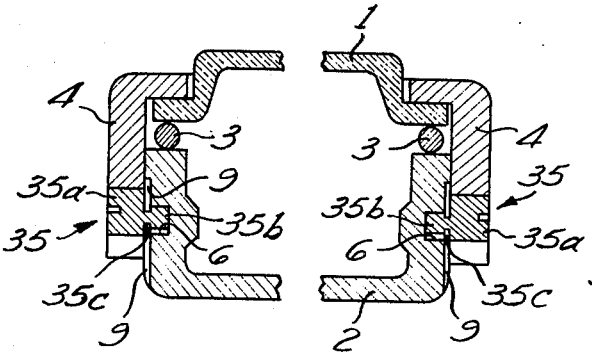
Figure 5B:
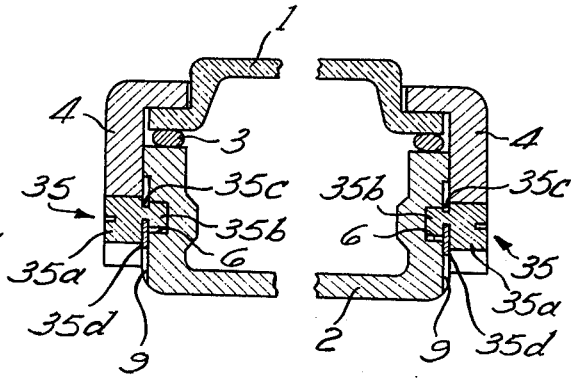
Figure 6A:
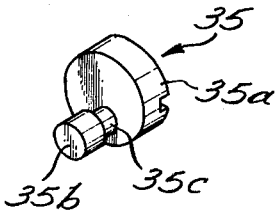
FIGS. 6A and 6B are perspective views showing in an enlarged scale the pin and the profile members to be engaged into this pin as shown by FIG. 5B.
Figure 6B:
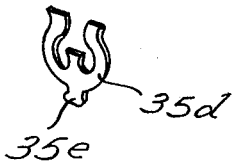
Figure 6C:
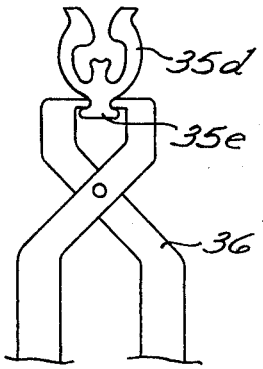
FIG. 6C is a schematic diagram showing a combination of the profile member and a special tool necessary for removal of said profile member as shown by FIGS. 5B and 6B from the position of FIG. 5B.
Figure 7:
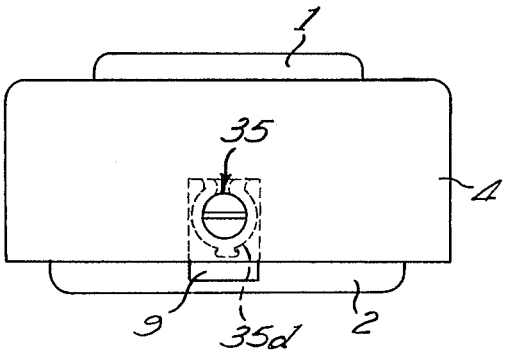
FIG. 7 is a side view showing the watchcase in the embodiment of the present invention as shown by FIGS. 5A to 6C.

In the coupling structure of watchcase as shown by FIGS. 5A and 5B, an eccentric pin 35 as shown by FIG. 6A is used. This eccentric pin 35 is particularly arranged so that the function of coupling the watchcase may be prevented from being damaged as a result of falling off of said pin 35 axially outward due to some accidental causes. Specifically, a ring 35*d* provided independently of the eccentric pin 35 itself as shown by FIG. 6B is interposed between the outer rim 4 and the rear cap 2 and engaged with said eccentric pin 35 so that this ring 35d serves to prevent the eccentric pin 35 from falling off. The eccentric pin 35 includes, in addition to a head 35a and a shank 35*b*, a reduced diameter portion 35*c* as the intermediate portion. The rear cap 2 is provided in periphery of each hole 6 with a shallow notch 9 to facilitate insertion of the ring 35*d*, as best seen in FIG. 7. This notch 9 has its lateral width slightly larger than required for insertion of the ring 35d and this allowance corresponds to the eccentricity of the eccentric pin 35. FIG. 5A shows the state immediately after insertion of the eccentric pin 35 and, from this state, the ring 35*d* with its opened portion directed upward is inserted into a gap between the rear cap 2 and the outer rim 4, defined under the eccentric pin 35. The operation of inserting the ring 35d is preferably done after completion of substantial adjusting rotation of the eccentric pin 35, leaving the accurate adjustment of the force with which the packing 3 is clamped to be accomplished thereafter. As seen in FIG. 5B, the shank 35*b* occupies a position close to the uppermost position after the adjusting rotation of the eccentric pin 35 has been completed, and the upper end of the opened portion of the ring 35*d* occupies then a position close to the uppermost position of the shallow notch provided in the rear cap 2 so as to prevent the ring 35d from being rotated. The ring 35*d* is provided at its lower end with an extension 35*e* having a narrow portion so that said extension 35*e* may be grasped by a special tool 36 as shown by FIG. 6C to remove the ring 35*d* when it is required to dismantle the coupling structure of watchcase.

Figure 8:
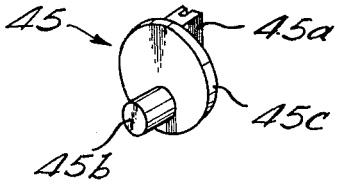
FIG. 8 is a perspective view showing in an enlarged scale an eccentric pin for coupling in further another embodiment of the present invention, said eccentric pin including further improvement such that a rigid flange is formed in unison with said pin and a head of said pin is configurated so as to be easily inserted into the outer rim.
Figure 9A:
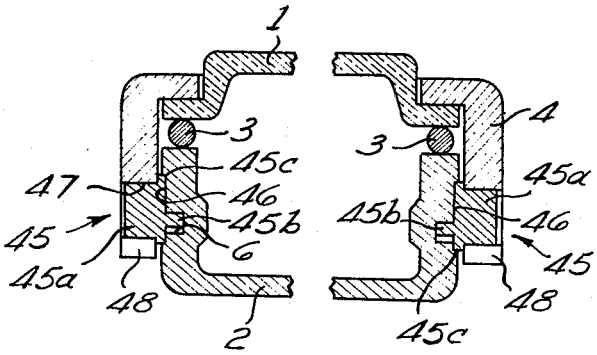
Figure 9B:
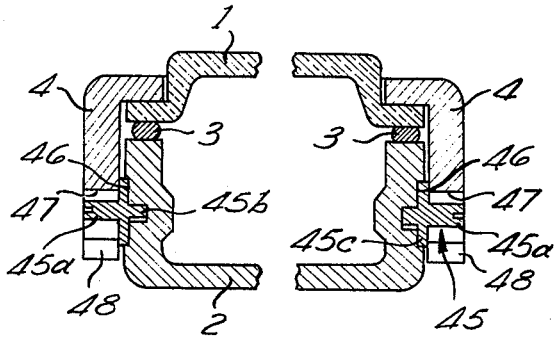
Figure 9C:
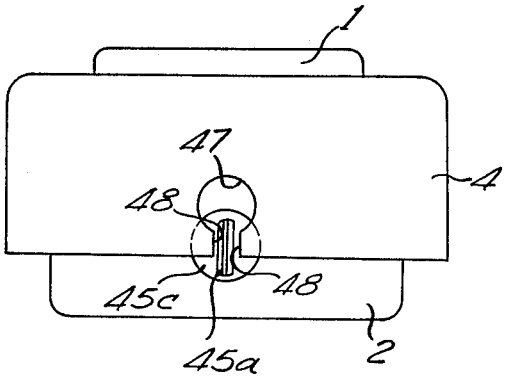
FIG. 9C is a side view showing a state on the way the eccentric pins as shown by FIG. 8 are inserted through the rear cap and the outer rim particularly configurated in conformity with the eccentric pins as shown by FIG. 8.

An eccentric pin 45 as shown by FIG. 8 includes a flange 45*c*, instead of said ring 35*d*, formed in unison with said eccentric pin 45, which serves to prevent the eccentric pin 45 from falling off. This eccentric pin 45 basically consists of three portions, namely, a head 45*a*, a shank 45*b* and said flange 45*c*. The flange 45*c* has a diameter larger than that of the head 45a so that said flange 45*c* may be interposed between the rear cap 2 and the outer rim 4 after coupling of the watchcase. To accomplish proper insertion of this eccentric pin 5 through and into the rear cap 2 and the outer rim 4, it is required that there should be a particular relationship between the outer rim 4 and the pin head 45*a* with respect to their configurations. Such a requirement, however, is not necessarily essential in the other embodiments wherein the ring 35*d* is used, since said relationship is expected in view of the fact that said flange 45*c* is rigidly and stationarily provided on the eccentric pin 45. The eccentric pin 45 accomplishes coupling of the outer rim 4 and the rear cap 2 through a combination of the particular configuration of the pin head 45*a* and the keyhole-like notch formed in the outer rim 4, as shown by FIG. 9C. Said keyhole-like notch of the outer rim 4 consists of a pin head insertion opening 47 having a diameter substantially equal to the maximum diameter of the pin head 45a and a pin head guide slit 48 to introduce the pin head 45a into said pin head insertion opening 47. An angular extent over which the eccentric pin 45 as shown by FIG. 8 may be adjustable rotated is limited to approximately 90° in combination with the pin head insertion opening 47 as shown by FIG. 9C. Accordingly, the eccentricity of the eccentric pin 45 which depends on the distance between the axes of the pin head and the pin shank must correspond at least to the allowance required to adjust the force with which the packing 3 is clamped, and this extent of eccentricity is twice the eccentricity of the eccentric pin as shown by FIGS. 2 and 7. Said angular extent over which the eccentric pin 5 may be adjustably rotated will be enlarged to approximately 140° if there is provided a small stop adapted to restrain rotation of the pin head 45*a* on the pin head insertion opening 47 adjacent a position at which said pin head insertion opening 47 is merged into the pin head guide slit 48.

In coupling the rear cap 2 and the outer rim 4 by use of the eccentric pin 45, as best seen in FIG. 9C, the shank 45*b* and the flange 45*c* thereof are inserted into a shank insertion hole 46 and a flange insertion hole 46 both provided in the rear cap 2, respectively, with the head 45*a* thereof being held so that its longitudinal side is vertically directed, then the outer rim 4 is assembled from above, while the eccentric pin 45 is held, and the pin head 45*a* is introduced through the pin head guide slit 48 into the pin head insertion opening 47. The eccentric pin 45 is thereafter adjustably rotated to adjust the force with which the packing 3 is clamped as seen in FIGS. 9A and 9B.

Figure 10A:
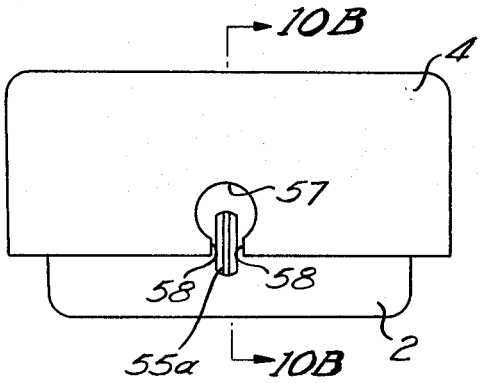
Figure 10B:
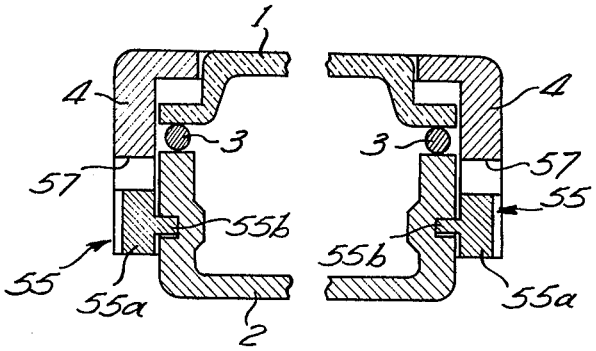
Figure 10C:
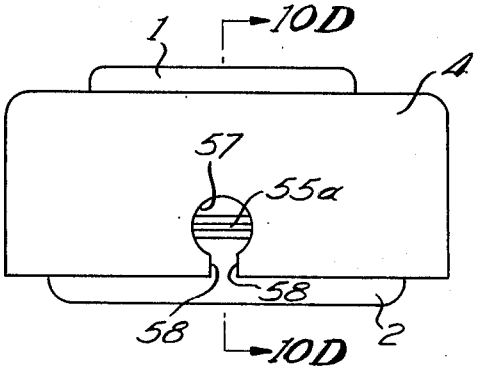
Figure 10D:
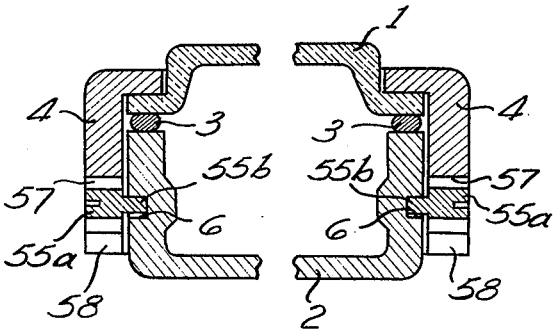
Figure 11:
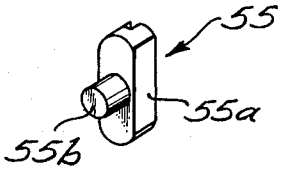
FIG. 11 is an enlarged perspective view of the pin as shown by FIGS. 10A to 10D.

FIGS. 10A to 10D show further another embodiment of the coupling structure of watchcase comprising a combination of a pin 55 as shown by FIG. 11 and the outer rim having a notch in the form of the keyhole as previously mentioned. The pin of FIG. 11 which is used in this particular coupling structure merely consists of a head 55*a* and a shank 55*b* with no eccentricity. Accordingly, the rear cap 2 as shown by FIGS. 10A to 10D has no flange insertion hole 46 as formed in the rear cap 2 of FIG. 9. The pin 55 has no eccentricity in this embodiment, so that the force with which the packing 3 is clamped is not adjustable. This embodiment corresponds to an improved coupling structure of watchcase which relies upon a particular manner of coupling the outer rim 4 to the rear cap 2, instead of simple insertion of the coupling pin through and into the outer rim 4 and the rear cap 2 lying one upon another. The force with which the packing 3 is clamped principally depends upon the precision with which the respective parts of the coupling structure are machined on one side and upon the position at which the hole 6 for insertion of the shank 55b is machined in the rear cap 2.

Also in this embodiment, assembling of the coupling structure of watchcase is accomplished through the steps just as in the previous embodiment, namely, through the steps as shown by FIGS. 10A and 10B, and then assembled and adjusted to the states as shown by FIGS. 10C and 10D, in which the operation of assembling is completed.

Figure 12A:
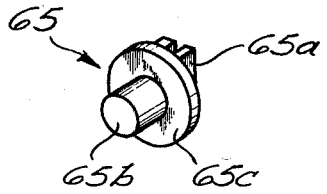
Figure 12B:
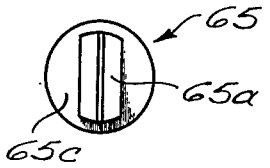
Figure 13A:
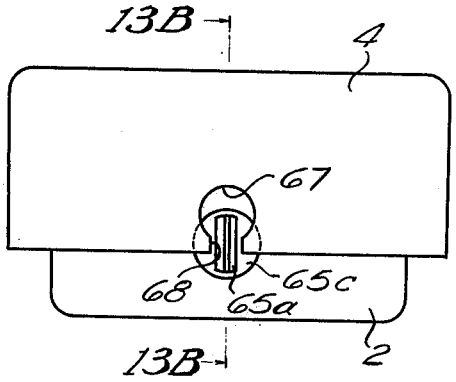
Figure 13B:
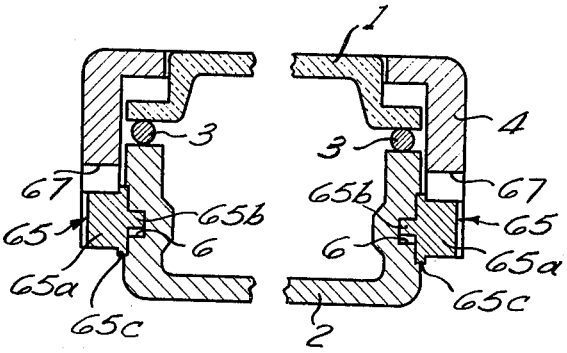
Figure 13C:
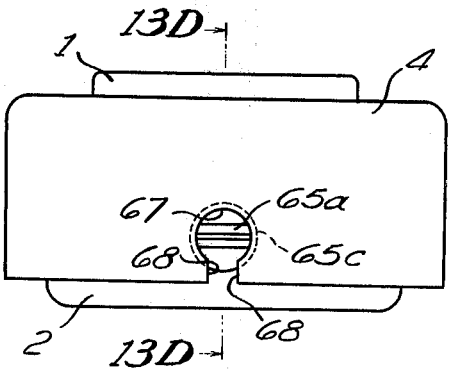
Figure 13D:
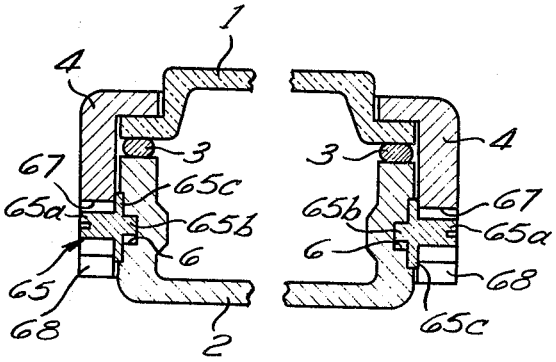

A pin as shown by FIGS. 12A and 12B corresponds to the pin as shown by FIG. 11 which is provided with a rigid flange larger than its pin head and formed in unison therewith, and is used as a coupling pin in still another embodiment of the present invention. This pin of FIGS. 12A and 12B is similar to the pin as shown by FIG. 11 in that its head 65*a* and shank 65*b* axially coincide with each other and have no eccentricity. The flange 65*c* larger than the pin head 65a may have noncircular shapes such as an oval, so long as said flange 65*c* may be effectively carried between the rear cap 2 and the outer rim 4 to prevent the pin 65 from falling off. In assembling the watchcase coupling structure utilizing this pin also, the pin head 65*a* is introduced through a pin head guide slit 68 into a pin head insertion opening 67 and turned approximately by 90° to complete the operation of assembling.

In this embodiment, as in the embodiment of FIGS. 10 and 11, the force with which the packing 3 is clamped principally depends upon the precision and the positions with and at which the hole 6 of the rear cap 2, the head insertion opening 67 of the outer rim 4, the pin 65 and the other parts are machined.

Figure 14A:
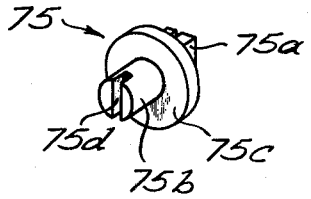
Figure 14B:
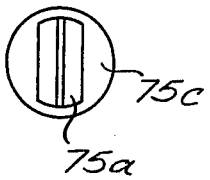

In still further another embodiment of the present invention as shown by FIGS. 14 and 15, a pin 75 as shown by FIG. 14 has a pin head 75*a*, a circular flange 75*c* of a diameter larger than that of said pin head 75*a*, a shank 75*b* and a notch 75*d* formed in the front end of said shank 75*b*. The rear cap 2 is provided with an opening 76*a* extending therethrough, into which the pin shank 75*b* is inserted, as shown by FIGS. 15B and 15D.

Figure 15A:
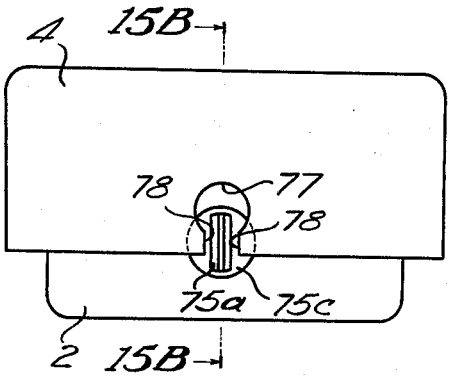
Figure 15B:
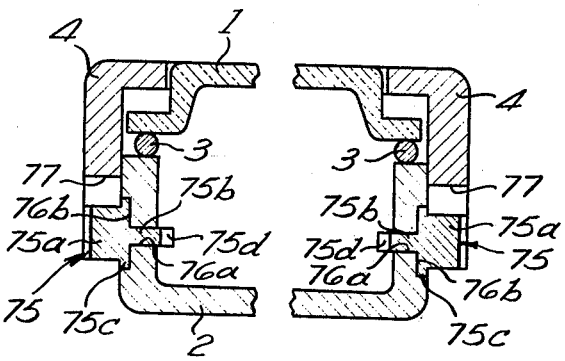
Figure 15C:
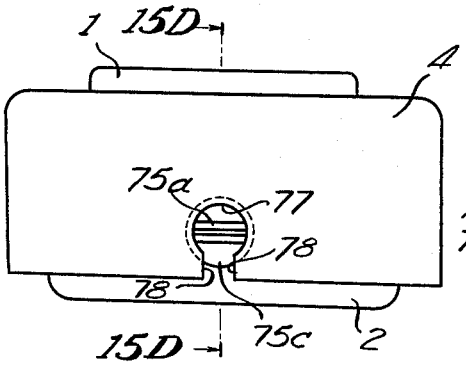
Figure 15D:
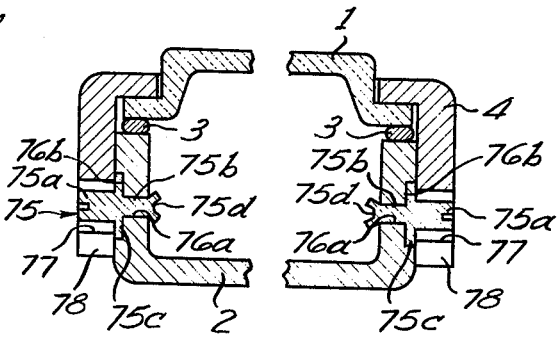

This embodiment is employed particularly when the outer rim 4 is limited in its thickness and, in this case, a waterproof function of the coupling structure reduced by formation of the opening 76*a* extending through the rear cap 2 must be compensated by some means. To this end, a flange insertion hole 76*b* is formed around the opening 76*a* of the rear cap 2, into which a circular flange 75*c* is fitted, and the flange 75*c* thus fitted into the flange insertion hole 76*b* is forced against the outer rim 4 and thereby said flange 75*c* is brought into a tight contact with said flange insertion hole 76*b*, as shown by FIGS. 15B and 15D.

The coupling structure according to this embodiment is assembled in a manner different from the manner in which the other embodiments are assembled. First, the pin having the notch as shown by FIG. 14 is mounted on the rear cap having therein no inner mechanism as a movement and then the notch 75*d* is expanded to secure the pin 75 in the rear cap 2. Holding the head 75*a* of the pin 75 with its longitudinal side being vertically directed, the rear cap 2 having therein the inner mechanism, the packing 3, the front cap 1 and the outer rim 4 are assembled, as shown by FIG. 15A. The operation of assembling is completed by turning the pin head 75*a* as seen in FIG. 15C after said pin head 75*a* has been completely inserted through a pin head guide slit 78 of the outer rim 4 into a pin head insertion opening 77.

Also in this embodiment, the force with which the packing 3 is clamped substantially depends upon the precision and the positions with and at which the respective parts of the watchcase coupling structure are machined.

The first to seventh embodiments of the watchcase coupling structure according to the present invention have several features and are commonly characterized by that the operation of assembling may be accomplished at high efficiency and, accordingly, at high productivity without relying on a threading effect in clamping the coupling pin.

According to the embodiment as shown by FIGS. 1 to 3, the coupling structure may be, in addition to the common feature as mentioned above, adjusted in an extremely easy manner so that the optimal packing clamping force is obtained and the appropriate water- and dust-proof effect is always assured. With the packing made of rubber or the like, the useful life of the packing may be reduced when an excessive clamping force increases deformation or loading beyond the critical level. According to this embodiment, however, the clamping force exerting on the packing may be kept appropriate so that unevenness of usefull life of the packing is eliminated and the reliability of water- and dust-proof function required for the watchcase coupling structure is improved.

According to the embodiment as shown by FIG. 4, the operation of assembling of the eccentric pin may be further facilitated, in addition to the common feature as previously mentioned, and the efficiency at which said operation of assembling is carried out may be further improved.

The eccentric pin as shown by FIGS. 5 and 6A includes the ring portion 35*d* to be interposed between the rear cap and the outer rim and the eccentric pin may be securely prevented from falling off in the axial direction once said eccentric pin has been assembled.

In accordance with the embodiment as shown by FIGS. 8 and 9, the outer rim 4 is provided with the pin head guide slit 48 so that coupling of the watchcase may be achieved without insertion of the coupling pin through the outer rim 4 and the rear cap 2 lying one upon another. This embodiment presents the improvement not only that the operation of assembling is thus facilitated but also that the limitation to the coupling pin's configuration is moderated. More specifically, it is possible according to this embodiment to incorporate even the pin 45 which is provided with the flange 45*c* of the diameter larger than that of the pin head 45*a* into the watchcase coupling structure. As a result, the pin 45 may be prevented from falling off by employing the pin as shown by FIGS. 5 and 6A.

According to the embodiment as shown by FIGS. 10 and 11, the operation of assembling is easily accomplished since the outer rim 4 is mounted after the coupling pin 55 has been mounted in the rear cap 2, and the coupling pin 55 itself can be easily fabricated at a low cost because of its the simplest configuration.

In accordance with the embodiment as shown by FIGS. 12 and 13, the operation of assembling is facilitated just as the embodiment of FIGS. 10 and 11 by employing the manner of assembling in which the outer rim 4 is mounted after the pin 65 has been mounted in the rear cap 2, and the rigid flange 65*c* formed in unison with the pin 65 is carried by the rear cap 2 and the outer rim 4 to prevent the pin 65 from falling off. The flange 65*c* is securely caught between the rear cap 2 and the outer rim 4 and, as a result, there increases a frictional force to prevent undesired rotation of said pin 65 which has once been mounted and adjusted and to reinforce inadequate frictional force between the pin head 65a and the pin head insertion opening 67.

According to the embodiment as shown by FIGS. 14 and 15, it is possible to mount the coupling pin even in the outer rim of a small thickness and the pin 75 is well prevented from falling off once said pin 75 has been mounted and adjusted. Further, the circular flange 75*c* securely caught between the rear cap 2 and the outer rim 4 provides a frictional force enough to prevent undesired rotation of said pin 75 and the waterproof function substantially reduced by provision of the opening extending through said rear cap 2 may be effectively compensated by the circular flange 75*c* which tightly bears against the rear cap 2.

It will be easy for those skilled in the art to suggest various modifications of the present invention without departure from the spirit of the present invention. These modifications will be described by way of example.

The embodiment as shown by FIGS. 8 and 9 may be modified, for example, in such a manner that the coupling pin 5 is provided with a projected member adapted to be interposed between the rear cap and the outer rim in the place of the rigid flange 5*d* and said projected member is compressed and inserted into the pin head insertion opening of the outer rim in the form of a circular opening during the operation of assembling.

The embodiment as shown by FIGS. 10 and 11 may be modified, for example, in such a manner that the coupling pin 55 has an eccentricity between its head 55*a* and shank 55*b*.

The embodiment as shown by FIGS. 12 and 13 may be modified, for example, in such a manner that the shank 65*b* is omitted and the thickness of the flange 65*c* is increased to establish an eccentricity between said flange 65*c* and the pin head 65*a* or that one of bridge portions connecting the pin head guide slit and the pin head insertion opening is provided with a stop adapted to prevent the pin head from rotating.

The embodiment as shown by FIGS. 14 and 15 may be modified, for example, in such a manner that, instead of formation of the circular flange 75*c*, the coupling pin is provided with a shank 75*b* which is tapered toward its front end the rear cap is provided with an opening in conformity with this tapered shank of the coupling pin. Alternatively, a modification may be proposed so as to establish an eccentricity between the pin head 75*a* and the pin shank 75*b*.

In use of the eccentric pins of all the types as disclosed in the embodiments as described hereinabove, it is easy to those skilled in the art to design the configuration of the holes or the openings provided in the rear cap so that there occurs a relative displacement only in the vertical direction between the outer rim and the rear cap to clamp the packing without undesired relative displacement in the horizontal direction.

Finally, the embodiment as shown by FIGS. 9 to 11 may be also modified in such a manner that the portion of the pin head 55a which comes into a slidable contact with the pin head insertion opening 57 of the outer rim 4 is configurated as a conical surface and said pin head insertion opening 57 of the outer rim 4 is correspondingly configurated in conformity with said conical surface of the pin head so as to prevent the pin 55 from falling off.

What we claim is:

1. A coupling structure of watchcase comprising a front cap, a rear cap in which an inner mechanism is accommodated, a packing interposed between the front cap and rear cap, an outer rim peripherally engaged with said front cap and covering a zone at which said front cap abuts on said rear cap with interposition of said packing and coupling pins mounted in said rear cap and said outer rim, wherein said pin comprises an eccentric pin having an eccentricity between the axes of its head and threadless shank which corresponds to a margin required to adjust a force with which said packing is clamped and is inserted for rotary adjustment through and into said outer rim in engagement with said front cap and said rear cap, said eccentric pin being received within openings in said outer rim and rear cap and being configurated so that the periphery of the head and the shank present a slant surface for initially biasing said outer rim toward said rear cap and aligning said openings as said eccentric pin is received within said openings.

2. A coupling structure of watchcase comprising a front cap, a rear cap in which an inner mechanism is accommodated, a packing interposed between the front cap and rear cap, an outer rim peripherally engaged with said front cap and covering a zone at which said front cap abuts on said rear cap with interposition of said packing and coupling pins mounted in said rear cap and said outer rim, wherein said pin comprises an eccentric pin having an eccentricity between the axes of its head and shank which corresponds to a margin required to adjust a force with which said packing is clamped and is inserted for rotary adjustment through and into said outer rim in engagement with said front cap and said rear cap, said eccentric pin having a diameter reduced portion adapted to be located between the rear cap and the outer rim when said pin is mounted in said outer rim and said rear cap and there is arranged a ring between said rear cap and said outer rim to be fit around said diameter reduced portion of said eccentric pin.

3. A coupling structure of watchcase comprising a front cap, a rear cap in which an inner mechanism is accommodated, a packing interposed between the front cap and rear cap, an outer rim peripherally engaged with said front cap and covering a zone at which said front cap abuts on said rear cap with interposition of said packing and coupling pins mounted in said rear cap and said outer rim, wherein said pin comprises an eccentric pin having an eccentricity between the axes of its head and shank which corresponds to a margin required to adjust a force with which said packing is clamped and is inserted for rotary adjustment through and into said outer rim in engagement with said front cap and said rear cap, said eccentric pin having a head of the cross-sectional shape of a circle symmetrically cut away to present a pair of parallel surfaces, a flange having a diameter larger than that of said head formed in unison with said head and said shank at a joint portion of said head and said shank so as to be interposed between the rear cap and the outer rim and the outer rim having a keyhole-shaped notch to introduce and mount said eccentric pin.

4. A coupling structure of watchcase comprising a front cap, a rear cap in which an inner mechanism is accommodated, a packing interposed between these front cap and rear cap, an outer rim peripherally engaged with said front cap and covering a zone at which said front cap abuts on said rear cap with interposition of said packing and a coupling pin adapted to be mounted in said rear cap and said outer rim, wherein said coupling pin has a head of the cross-sectional shape of a circle symmetrically cut away to present a pair of parallel surfaces and said outer rim has a keyhole-shaped notch to introduce and mount said pin.

5. A coupling structure of watchcase according to claim 4, wherein the coupling pin has a flange having a diameter larger than that of its head formed in unison with said head and shank at a joint portion of these head and shank to be interposed between the rear cap and the outer rim.

6. A coupling structure of watchcase according to claim 4, wherein the coupling pin has a notch on a front end of its shank adapted to be expanded after the coupling pin has been mounted and a circular flange having a diameter larger than that of its head formed in unison with said head and shank, and the rear cap has an opening extending there through into which said shank of the pin is inserted so that the pin is forced against the rear cap after said pin has been mounted in said rear cap and the outer rim to make said opening waterproof.

* * * * *